US011530587B1

(12) United States Patent
Wright

(10) Patent No.: US 11,530,587 B1
(45) Date of Patent: Dec. 20, 2022

(54) NON-ELECTRIC EXPLOSIVE DEVICE AND METHOD OF SEVERING A TUBULAR

(71) Applicant: David C. Wright, Spring, TX (US)

(72) Inventor: David C. Wright, Spring, TX (US)

(73) Assignee: WRIGHT'S IP HOLDINGS, LLC, Magnolia, TX (US)

( * ) Notice: Subject to any disclaimer, the term of this patent is extended or adjusted under 35 U.S.C. 154(b) by 40 days.

(21) Appl. No.: 17/328,755

(22) Filed: May 24, 2021

(51) Int. Cl.
*E21B 31/00* (2006.01)
*F42C 1/04* (2006.01)
*E21B 17/10* (2006.01)

(52) U.S. Cl.
CPC ..... *E21B 31/002* (2013.01); *F42C 1/04* (2013.01); *E21B 17/1078* (2013.01)

(58) Field of Classification Search
CPC ..... E21B 7/007; E21B 7/1245; E21B 23/04–0423; E21B 23/065; E21B 43/248; E21B 43/263; E21B 29/02; E21B 31/002; E21B 31/1075; E21B 31/16; E21B 49/04; F42C 1/04
See application file for complete search history.

(56) References Cited

U.S. PATENT DOCUMENTS

| | | | | |
|---|---|---|---|---|
| 2,500,990 | A * | 3/1950 | Higginbotham | E21B 36/02 166/70 |
| 2,699,721 | A | 1/1955 | Klotz, Jr. | |
| 3,185,224 | A * | 5/1965 | Robinson, Jr. | E21B 7/007 175/4.54 |
| 4,509,604 | A | 4/1985 | Upchurch | |
| 4,610,312 | A | 9/1986 | Nelson et al. | |
| 4,924,952 | A | 5/1990 | Schneider | |
| 5,115,865 | A | 5/1992 | Carisella et al. | |
| 5,992,289 | A | 11/1999 | George et al. | |

* cited by examiner

*Primary Examiner* — Kristyn A Hall
(74) *Attorney, Agent, or Firm* — McCutcheon Joseph, PLLC

(57) ABSTRACT

A non-electric explosive device includes a primary body containing cutting material and including a primary charge positioned in the cutting material; an explosive body at a first axial end of the primary body and including explosive material; and a firing head at a second axial end of the primary body, the firing head including a firing pin secured at least partially inside the firing head via securing device, the firing pin comprising an activating end proximate the primary charge and a blunt end protruding from a distal end of the firing head. A force applied to the blunt end of the firing pin causes the firing pin to retract toward the primary charge and break the securing device so that the activating end of the retracting firing pin impacts the primary charge which ignites the explosive material that causes the cutting material in the primary body to travel radially outward.

13 Claims, 2 Drawing Sheets

NON-ELECTRIC EXPLOSIVE DEVICE AND METHOD OF SEVERING A TUBULAR

BACKGROUND

1. Field of the Invention

The present disclosure relates to an explosive device and method for severing a tubular, such as a pipe, tube, casing and casing liner. In particular, the disclosure relates to an explosive device that is devoid of an electric mechanism for igniting the device, and that is configured to be dropped into the tubular from the surface. Impact of the device against the bottom of the well containing the tubular, or against a tool in the tubular, causes explosive material in the explosive device to ignite. Ignition causes material in the device to travel radially outward to sever the tubular.

2. Description of Related Art

Some explosive devices have firing pins that are triggered by a falling weight or increase in fluid pressure. The triggered firing pin impacts a detonation device causing explosive material to ignite. For instance, a "tubing conveyed perforator" (TCP) is known, which utilizes an impact-actuated detonating train rather than a surface source of electrical power. Once the TCP tool is at a desired depth location in a well bore, it is then selectively initiated from the surface either by dropping a "drop bar" through the tubing string or by varying the pressure inside of the tubing string and in the well bore until a predetermined pressure level or pressure differential is reached. In either case, the initiation of the TCP tool will either release or forcibly drive a movable detonating member against an impact-responsive explosive with sufficient force to detonate it.

A similar device may include a firing head having a piston reciprocably received in a fluid chamber, and an orifice for metering fluid from the chamber. When the firing head is engaged with the explosive device, weight is applied to the piston, thereby forcing fluid from the chamber through the orifice and producing a time delay. After the piston has traveled a predetermined distance relative to the chamber, its further displacement is relatively unrestricted and the weight drives the piston downwardly to cause detonation of the explosive device.

A redundant firing mechanism for a perforating gun is also known. The firing mechanism has a housing that incorporates two spaced primer charges disposed in a vertically spaced relationship. A fluid pressure chamber within the housing assembly is closed at the top end of the assembly by a frangible barrier disc. A fluid pressure actuated hammer is provided to impact upon the lowermost one of the primers in response to fluid pressure developed in the fluid pressure chamber. In the event that the lowermost primer does not detonate, a detonating bar may then be dropped through the tubing string to break the frangible barrier and impact upon a second hammer disposed in overlying relationship to the second primer.

A simpler system involves an explosive cutting device in which a weight is lowered into a borehole after the cutting device is in position. The weight is dropped a short distance to engage the head of the plunger causing the plunger to move downward and strike a firing pin to ignite a detonating cap and, in turn an explosive charge.

SUMMARY

A need exists for an explosive device that is simple in design, can be dropped from the surface, and that is devoid of an electric mechanism for igniting the device.

The present disclosure meets these needs, and is directed to a non-electric explosive device and method for severing a tubular, such as a pipe, tube, casing and casing liner.

In a preferred embodiment, the non-electric explosive device comprises a primary body containing cutting material and including a primary charge positioned in the cutting material; an explosive body at a first axial end of the primary body and including explosive material; and a firing head 16 at a second axial end of the primary body, the firing head including a firing pin secured at least partially inside the firing head via securing device, the firing pin comprising an activating end proximate the primary charge and a blunt end protruding from a distal end of the firing head. A force applied to the blunt end of the firing pin causes the firing pin to retract toward the primary charge and break the securing device so that the activating end of the retracting firing pin impacts the primary charge which ignites the explosive material that causes the cutting material in the primary body to travel radially outward.

In an embodiment, the firing pin is detachable from the firing head. The firing pin may be detachable from the firing head via a threadable pin casing.

In an embodiment, the securing device comprises at least two set screws that are attached to a side wall of the firing head, and that have tips engaging a portion of the firing pin for stabilizing the firing pin in the firing head.

In an embodiment, the firing head comprises a spring that provides a biasing force against the firing pin to provide a distance between the activating end of the firing pin and the primary charge. The force applied to the blunt end of the firing pin causes the firing pin to retract against the biasing force of the spring.

In an embodiment, the spring may bear against a compression washer located between the securing device and the spring.

In an embodiment, the primary body further comprises first threads at the first axial end and second threads at the second axial end, and the first threads threadably connect the primary body to the explosive body, and the second threads threadably connect the primary body to the firing head.

In an embodiment, the explosive body comprises a plurality of guide fins protruding radially from the explosive body for centralizing the non-electric explosive device inside a tubular.

In an embodiment, the cutting material comprises balls which are configured to travel radially outward in a direction normal to a longitudinal axis of the non-electric explosive device when the explosive material is ignited.

In an embodiment, the firing head further comprises a nose cone covering the blunt end of the firing pin.

In a further embodiment, a method of severing a tubular comprises assembling a non-electric explosive device by attaching an explosive body including explosive material to a first axial end of a primary body, the primary body containing cutting material and including a primary charge positioned in the cutting material, and attaching a firing head to a second axial end of the primary body, the firing head including a firing pin secured at least partially inside the firing head via securing device, the firing pin comprising an activating end proximate the primary charge and a blunt end protruding from a distal end of the firing head; and dropping the non-electric explosive device into the tubular with the firing head facing downward so that the protruding blunt end of the firing pin impacts a bottom of the well containing the tubular, or a tool in the tubular. Impact of the blunt end of the firing pin causes the firing pin to retract toward the primary charge and break the securing device so that the activating end of the retracting firing pin impacts the primary charge, which ignites the explosive material and creates a blast that propels the cutting material in the primary body radially outward and through a wall of the tubular.

In an embodiment, the method further comprises centralizing the non-electric explosive device within the tubular via a plurality of guide fins protruding radially from the explosive body.

BRIEF DESCRIPTION OF THE DRAWINGS

Various embodiments are hereafter described in detail and with reference to the drawings wherein like reference characters designate like or similar elements throughout the several figures and views that collectively comprise the drawings.

DETAILED DESCRIPTION

Before explaining the disclosed embodiments in detail, it is to be understood that the present disclosure is not limited to the particular embodiments depicted or described, and that the invention can be practiced or carried out in various ways. The disclosure and description herein are illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. Further, the relative size and arrangement of the components may differ from that shown and still operate within the spirit of the invention.

Moreover, as used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments discussed herein. However, when applied to equipment and methods for use in wells that are deviated or horizontal, such terms may refer to a left to right, right to left, or other relationship as appropriate. In the specification and appended claims, the terms "pipe", "tube", "tubular", "casing" and/or "other tubular goods" are to be interpreted and defined generically to mean any and all of such elements without limitation of industry usage. Because many varying and different embodiments may be made within the scope of the concept(s) herein taught, and because many modifications may be made in the embodiments described herein, it is to be understood that the details herein are to be interpreted as illustrative and non-limiting.

Figure 1:
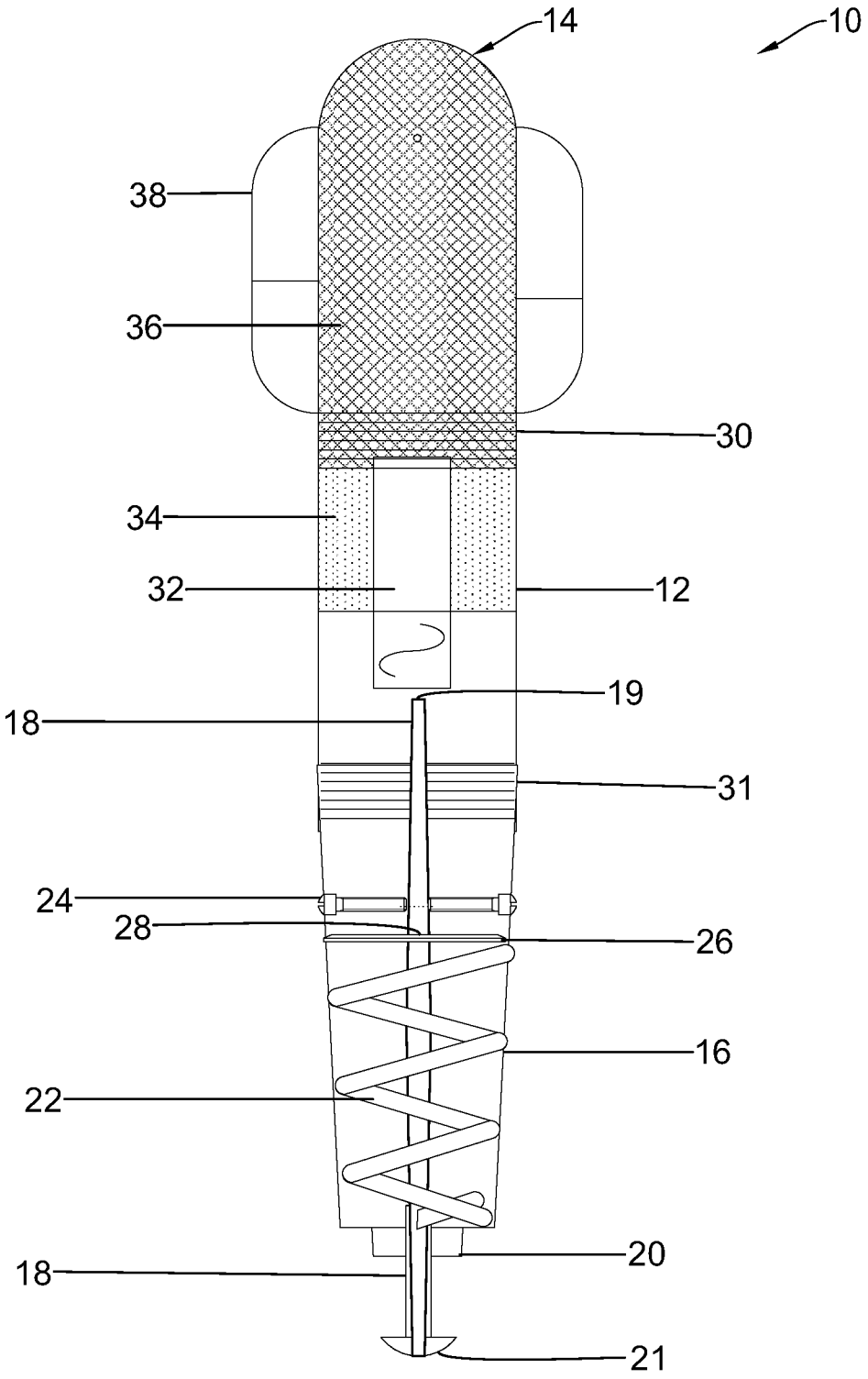
FIG. 1 is a cross-sectional side view of an embodiment of a non-electric explosive device usable within the scope of the present disclosure.
Figure 2:
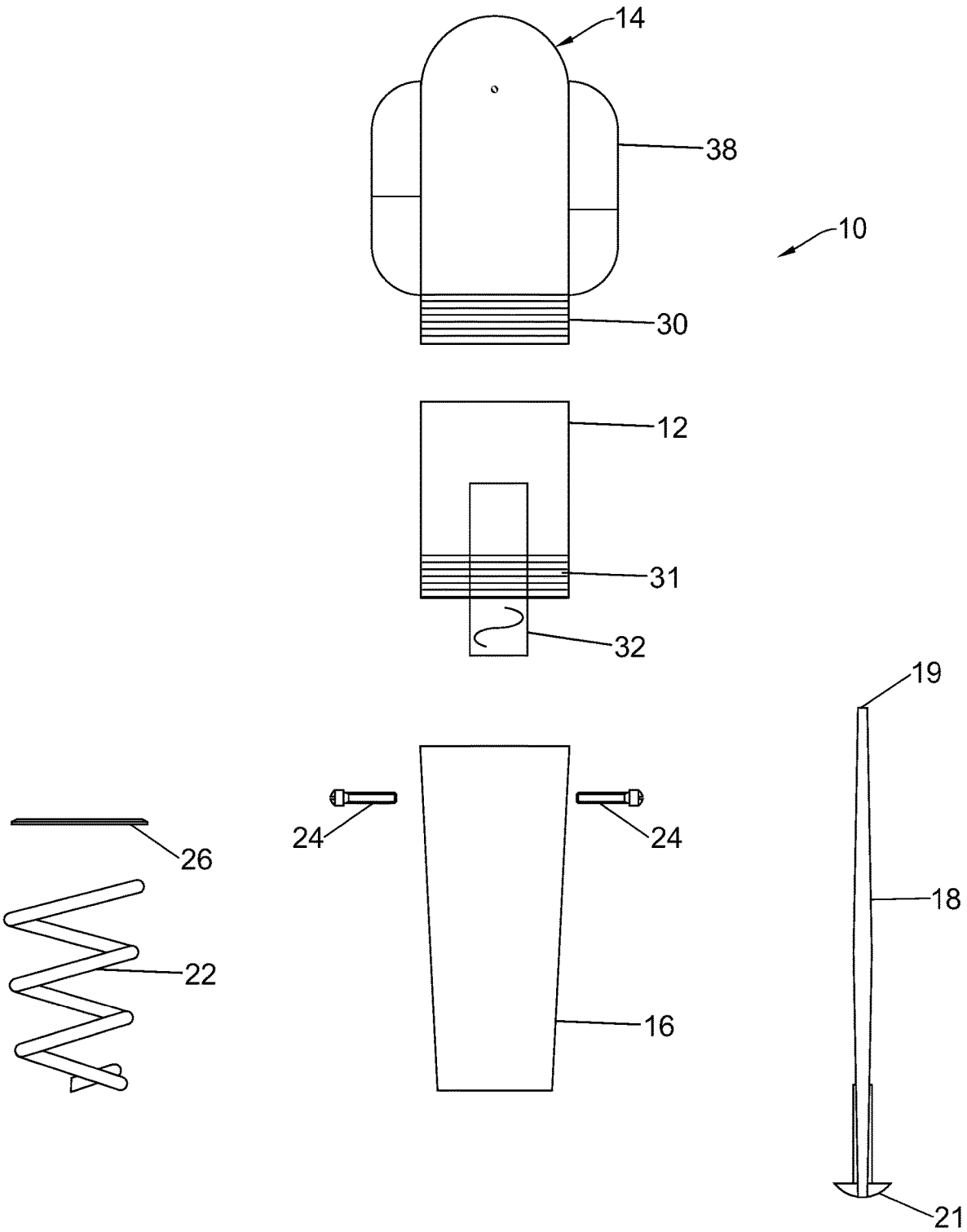
FIG. 2 is an exploded view of the non-electric explosive device in FIG. 1 according to an embodiment.

FIGS. 1 and 2 show a preferred embodiment of a non-electric explosive device 10. The non-electric explosive device 10 is generally formed of three main components: a primary body 12, an explosive body 14, and a firing head 16 positioned relative to each other in the manner illustrated in FIG. 1. Specifically, the explosive body 14 is located at a first axial end of the primary body 12, and the firing head 16 is located at a second axial end of the primary body 12. In an embodiment, a first axial end of the primary body 12 may include first threads 30 that engage with corresponding threads (not shown) of the explosive body 14 to releasably attach the primary body 12 to the explosive body 14. Similarly, a second axial end of the primary body 12 may include second threads 31 that engage with corresponding threads (not shown) of the firing head 16 to releasably attach the primary body 12 to the firing head 16. The threaded connection of the primary body 12 with the explosive body 14 and the firing head 16 allow for easy maintenance, repair and/or replacement of the component parts of the non-electric explosive device 10. For instance, the firing head 16 could be detached from the primary body 12 and replaced with a different, e.g., larger or smaller, firing head that is attached to the primary body 12. Similarly, explosive body 14 could be detached from the primary body 12 and replaced with a different, e.g., more explosive/less explosive, explosive body 14. In some cases, a defective firing head 16 or explosive body 14 could be replaced with a working firing head 16 or explosive body 14 without replacing the primary body 12. And, a defective primary body 12 could be replaced with a working primary body 12 without replacing the firing head 16 or explosive body 14. The first threads 30 of the primary body 12 may also provide the option of attaching other devices to the primary body 12, such as a perforating gun (not shown), instead of the explosive body 14, depending on the desired application of the non-electric explosive device 10.

The connections between the working primary body 12 and the firing head 16 and the explosive body 14 are not limited to threads, and may include other connection means known in the art, such as screws and mechanical engagement devices, such as, but not limited to, a lock ring or snap on type connector. The geometric shape of the primary body 12, the firing head 16 and the explosive body 14 is not particularly limiting. In the illustrated embodiment, the primary body 12, the firing head 16 and the explosive body 14 are substantially cylindrical, so as to easily fit inside cylindrical tubulars known in the art. In an embodiment, the firing head 16 may be slightly conical to help the non-electric explosive device 10 easily enter the interior of a tubular.

The explosive body 14 includes explosive material 36, such as, but not limited to, TNT, RDX, PSTN, among other explosive materials. The primary body 12 contains cutting material 34. The cutting material 34 may comprise balls, shrapnel and/or other objects such as, but not limited to, Tungsten brass, steel, and other materials, that can cut through the wall of a tubular when they are projected to impact the wall at high speeds. The cutting material 34 is configured to travel radially outward in a direction normal to a longitudinal axis of the non-electric explosive device 10 when the explosive material 36 in the explosive body 14 is ignited. That is, ignition of the explosive material 36 creates a blast that propels the cutting material 34 radially outward.

The primary body 12 further includes a primary charge 32 that may be positioned in the cutting material 34. The primary charge 32 may be, for example, a primer or one or more percussion caps. The primary charge 32 is configured to ignite the explosive material 36 when the primary charge 32 is acted upon with a physical force. In one embodiment, the primary charge 32 is a bullet. In other embodiments, the primary charge 32 may be a primer or one or more percussion caps.

The firing head 16 includes a firing pin 18 that comprises an activating end 19 proximate the primary charge 32 when the firing head 16 is attached to the primary body 12, and comprises a blunt end 21 protruding from a distal end of the firing head 16, as shown in FIGS. 1 and 2. The firing pin 18 may be secured at least partially inside the firing head 16 via securing device 24 that stabilizes the firing pin 18 within the firing head, aligns the firing pin 18 with the primary charge 32, and prevents movement of the firing pin 18 axially toward the primary charge 32. In one embodiment, the securing device 24 comprises at least two set screws 24 that are attached to a side wall of the firing head 16, and that have tips that engage a surface of the firing pin 18. In other embodiments, the securing device 24 may be shear pins, such as brass shear pins or other types of pin materials such as, but not limited to, aluminum stainless copper that will shear when the blunt end 21 is engaged.

In a preferred embodiment, the firing pin 18 is detachable from the firing head 16, which allows the firing pin 18 to be removed from the remainder of the non-electric explosive device 10. The remainder of the device 10 can then be safely stored or transported without the risk of the firing pin 18 inadvertently impacting the primary charge 32. Detaching the firing pin 18 from the firing head may be useful for disarming the non-electric explosive device 10. The detachable firing pin 18 may thus be a safety benefit. The firing pin 18 may be detachable from the firing head 16 via a threadable pin casing 20. The threadable pin casing 20 may be provided at the distal end of the firing head 16. As a further safety precaution, the firing head 16 may include a detachable nose cone (not shown) covering the blunt end 21 of the firing pin 18. The nose cone protects the blunt end 21 of the firing pin 18 from being inadvertently impacted. The nose cone may thus be attached to the firing head 16 during storage or transport of the non-electric explosive device 10.

The firing head 16 may also comprise a spring 22. The spring 22 may bear against a compression washer 26 located between the securing device 24 and the spring 22. The compression washer 26 may be held in place via a locking ring 28. The spring 22 may be a coil spring, and is arranged in the firing head 16 to create a biasing force against the firing pin 18 to provide a distance between the activating end 19 of the firing pin 18 and the primary charge 32, as shown in FIG. 1.

The non-electric explosive device 10 is configured to be dropped into a tubular with the firing head 16 facing downward so that the protruding blunt end 21 of the firing pin 18 impacts the bottom of the well containing the tubular, or any tool in the well. The impact on the blunt end 21 causes the firing pin 18 to retract against the biasing force of the spring 22 and toward the primary charge 32. The retraction breaks the securing device 24 (e.g., the set screws 24), allowing the activating end 19 of the retracting firing pin 18 to impact the primary charge 32. The impact on the primary charge ignites the explosive material 36 resulting in a blast that propels the cutting material 34 in the primary body 14 to travel radially outward in a cutting fashion against the inner wall of the tubular. The impingement of the cutting material 34 on the inner wall of the tubular cuts the wall of the tubular. The amount of force necessary for the firing pin 18 to break the securing device 24 and impact the primary charge 32 may be, for example, 10 lbs/in$^2$.

In an embodiment, the explosive body 14 comprises a plurality of guide fins 38 protruding radially from the explosive body 14. The plurality may include two or more guide fins 38. The plurality of guide fins 38 serve collectively as a centralizer for centralizing the non-electric explosive device 10 while traveling inside the tubular.

A method of severing a tubular may comprise aspects of the embodiments discussed above, and combinations thereof. Generally, the method involves assembling the non-electric explosive device 10 by attaching the explosive body 14 to the first axial end of the primary body 12, and attaching the firing head 16 to the second axial end of the primary body 12. The primary body 12, the explosive body 14 and the firing head 16 may include the corresponding elements in the embodiments discussed above. the method includes dropping the non-electric explosive device 10 into the tubular with the firing head 16 facing downward so that the protruding blunt end 21 of the firing pin 18 impacts a bottom of the well containing the tubular, or a tool in the tubular. Impact of the blunt end 21 of the firing pin 18 causes the firing pin 18 to retract toward the primary charge 32 and break the securing device 24. The activating end 19 of the retracting firing pin 18 thus impacts the primary charge 32 which ignites the explosive material 36 resulting in a blast that propels the cutting material 34 in the primary body 14 radially outward and through a wall of the tubular to cut the tubular.

Although several preferred embodiments have been illustrated in the accompanying drawings and describe in the foregoing specification, it will be understood by those of skill in the art that additional embodiments, modifications and alterations may be constructed from the principles disclosed herein. These various embodiments have been described herein with respect to severing a "pipe" or a "tubular." Clearly, other embodiments of the tool of the present invention may be employed for severing any tubular good including, but not limited to, pipe, tubing, production/casing liner and/or casing. Accordingly, use of the term "tubular" in the following claims is defined to include and encompass all forms of pipe, tube, tubing, casing, liner, and similar mechanical elements.

What is claimed is:

1. A non-electric explosive device comprising:

a primary body containing cutting material and including a primary charge positioned in the cutting material;

an explosive body at a first axial end of the primary body and including explosive material; and a firing head at a second axial end of the primary body, the firing head including a firing pin secured at least partially inside the firing head via securing device, the firing pin comprising an activating end proximate the primary charge and a blunt end protruding from a distal end of the firing head, wherein a force applied to the blunt end of the firing pin causes the firing pin to retract toward the primary charge and break the securing device so that the activating end of the retracting firing pin impacts the primary charge which ignites the explosive material that causes the cutting material in the primary body to travel radially outward.

2. The non-electric explosive device of claim 1, wherein the firing pin is detachable from the firing head.

3. The non-electric explosive device of claim 2, wherein the firing pin is detachable from the firing head via a threadable pin casing.

4. The non-electric explosive device of claim 1, wherein the securing device comprises at least two set screws that are attached to a side wall of the firing head, and that have tips engaging a portion of the firing pin for stabilizing the firing pin in the firing head.

5. The non-electric explosive device of claim 1, wherein the firing head comprises a spring that provides a biasing force against the firing pin to provide a distance between the activating end of the firing pin and the primary charge.

6. The non-electric explosive device of claim 5, wherein the force applied to the blunt end of the firing pin causes the firing pin to retract against the biasing force of the spring.

7. The non-electric explosive device of claim 5, wherein the spring bears against a compression washer located between the securing device and the spring.

8. The non-electric explosive device of claim 1, wherein the primary body further comprises first threads at the first axial end and second threads at the second axial end, and the first threads threadably connect the primary body to the explosive body, and the second threads threadably connect the primary body to the firing head.

9. The non-electric explosive device of claim 1, wherein the explosive body comprises a plurality of guide fins protruding radially from the explosive body for centralizing the non-electric explosive device inside a tubular.

10. The non-electric explosive device of claim 1, wherein the cutting material comprises balls which are configured to travel radially outward in a direction normal to a longitudinal axis of the non-electric explosive device when the explosive material is ignited.

11. The non-electric explosive device of claim 1, wherein the firing head further comprises a nose cone covering the blunt end of the firing pin.

12. A method of severing a tubular, comprising:

assembling a non-electric explosive device by attaching an explosive body including explosive material to a first axial end of a primary body, the primary body containing cutting material and including a primary charge positioned in the cutting material, and attaching a firing head to a second axial end of the primary body, the firing head including a firing pin secured at least partially inside the firing head via securing device, the firing pin comprising an activating end proximate the primary charge and a blunt end protruding from a distal end of the firing head;

dropping the non-electric explosive device into the tubular with the firing head facing downward so that the protruding blunt end of the firing pin impacts a bottom of a well containing the tubular, or a tool in the tubular; and causing, via impact of the blunt end of the firing pin, the firing pin to retract toward the primary charge and break the securing device so that the activating end of the retracting firing pin impacts the primary charge, which ignites the explosive material and creates a blast that propels the cutting material in the primary body radially outward and through a wall of the tubular.

13. The method of claim 12, further comprising:

centralizing the non-electric explosive device within the tubular via a plurality of guide fins protruding radially from the explosive body.

* * * * *